US006533649B2

(12) United States Patent
Wang

(10) Patent No.: US 6,533,649 B2
(45) Date of Patent: Mar. 18, 2003

(54) SANDER ASSEMBLY HAVING ADJUSTABLE SANDER MEMBER

(76) Inventor: Tian Wang Wang, No. 45, Yi Chang East Road, Taiping City, Taichung Hsien (TW), 411

( * ) Notice: Subject to any disclaimer, the term of this patent is extended or adjusted under 35 U.S.C. 154(b) by 136 days.

(21) Appl. No.: 09/771,603

(22) Filed: Jan. 30, 2001

(65) Prior Publication Data

US 2002/0102929 A1 Aug. 1, 2002

(51) Int. Cl.[7] ..... B24B 7/28
(52) U.S. Cl. ..... 451/310; 451/361; 451/65
(58) Field of Search ..... 451/65, 139, 296, 451/236, 310, 311, 355, 360, 361

(56) References Cited

U.S. PATENT DOCUMENTS 5,168,656 A * 12/1992 Jolly et al. ..... 451/310
5,199,220 A * 4/1993 Steiner et al. ..... 451/310
5,361,546 A * 11/1994 Jonsson ..... 451/296
6,095,906 A 1/2000 Wang ..... 451/65

* cited by examiner

*Primary Examiner*—Joseph J. Hail, III
*Assistant Examiner*—David B. Thomas
(74) *Attorney, Agent, or Firm*—Charles E. Baxley

(57) ABSTRACT

A sander machine includes a motor coupled to a sander barrel for driving the sander barrel, a sander belt is engaged on a frame with two rollers, one of the rollers is coupled to and driven by the motor. The frame may be adjustably secured relative to the motor for adjusting the sander belt between a vertical working position and a horizontal working position, such that the sander barrel and the sander belt may be used for conducting three or more sanding operations. The sander barrel and the sander belt may be driven by a single motor.

1 Claim, 4 Drawing Sheets

SANDER ASSEMBLY HAVING ADJUSTABLE SANDER MEMBER

BACKGROUND OF THE INVENTION

1. Field of the Invention

The present invention relates to a sander, and more particularly to a sander assembly including an adjustable sander member.

2. Description of the Prior Art

The applicant has developed a typical sander device which has been issued as U.S. Pat. No. 6,095,906 to Wang and which includes a vertical sander barrel provided on top of a work table, and a sander wheel supporting on a supporting base. The sander barrel and the sander wheel may not be adjusted relative to the supporting base such that the sanders may not be conveniently used for conducting various kinds of sanding operations.

The present invention has arisen to mitigate and/or obviate the afore-described disadvantages of the conventional sanders.

SUMMARY OF THE INVENTION

The primary objective of the present invention is to provide a sander assembly including an adjustable sander member that may be adjusted between a horizontal working position and a vertical working position for conducting various kinds of sanding operations.

In accordance with one aspect of the invention, there is provided a sander assembly comprising a first sander member, a motor coupled to the first sander member for driving the first sander member, the motor including a spindle, a frame, a first roller and a second roller rotatably secured to the frame, the first roller being coupled to the spindle for being driven by the motor, a sander belt engaged around the first and the second rollers, and means for adjusting the sander belt between a vertical working position and a horizontal working position.

The frame includes a shaft rotatably secured therein and secured to the spindle for being driven by the motor, the first roller is secured on the shaft.

A bracket is slidably secured in the frame, the second roller is rotatably secured in the bracket, the bracket is adjustable and movable relative to the first roller for tightening the sander belt.

A seat is further provided and secured on a base and includes a clamping ring, a hub is secured to the frame and adjustably secured to the seat with the clamping ring.

A platform is further provided and secured to the frame for supporting work pieces. One or more covers are further provided and attached to the frame for partially shielding the sander belt.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
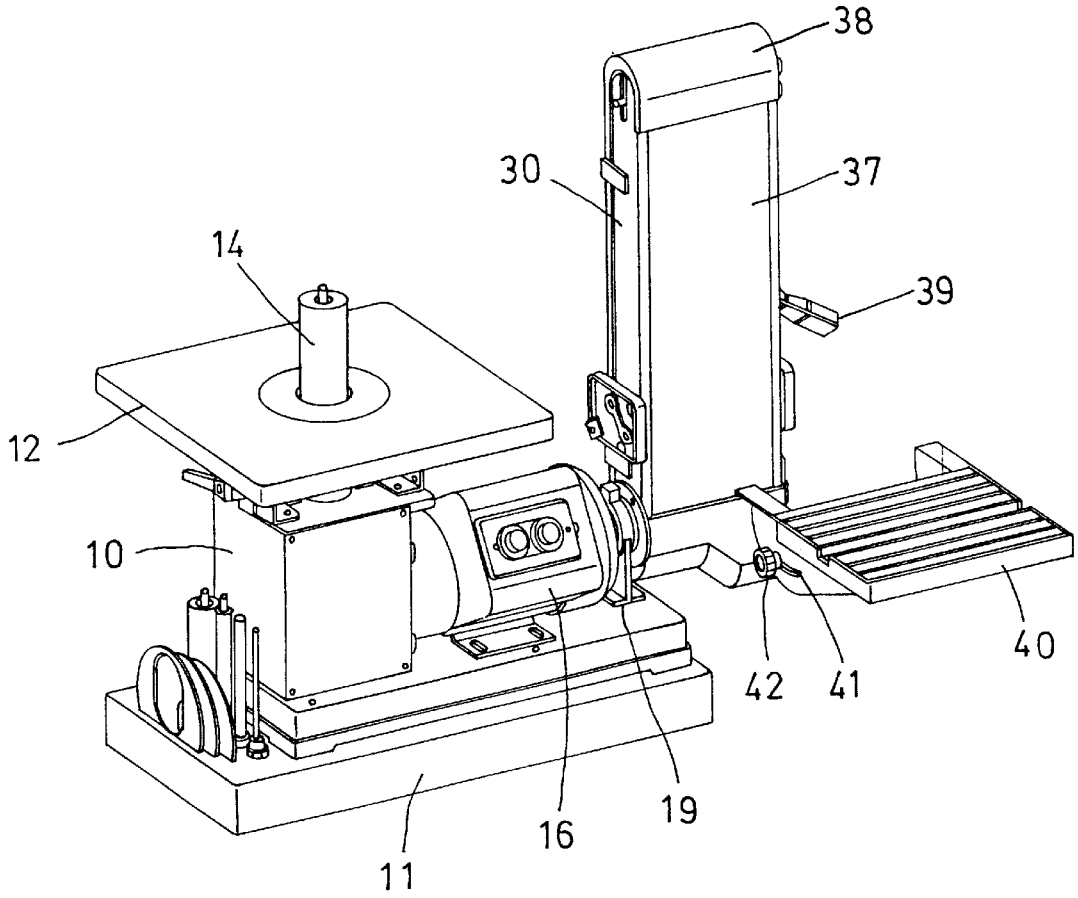
FIG. 1 is a perspective view of a sander assembly in accordance with the present invention.
Figure 2:
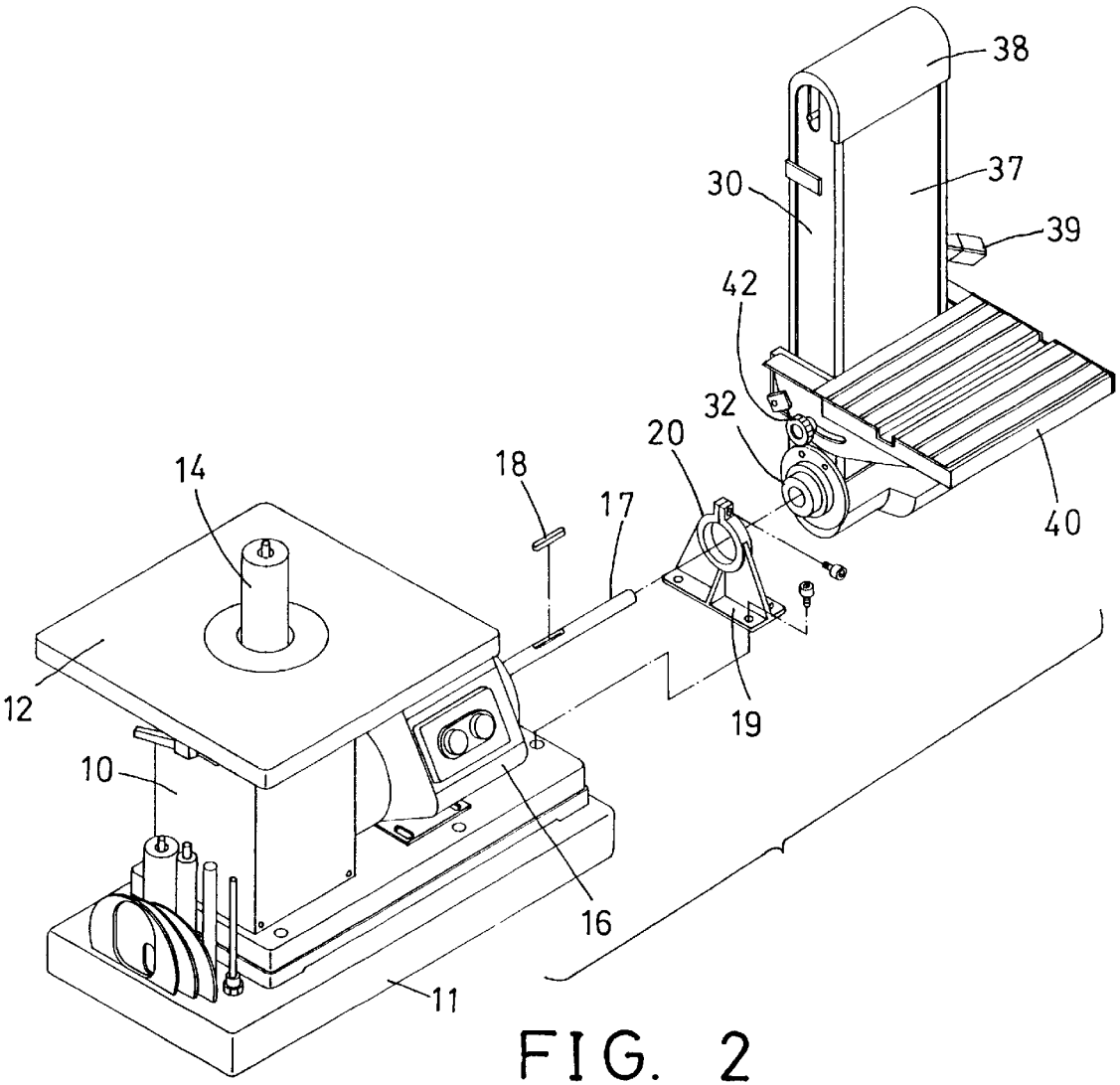
FIGS. 2 and 3 are partial exploded views of the sander assembly.
Figure 3:
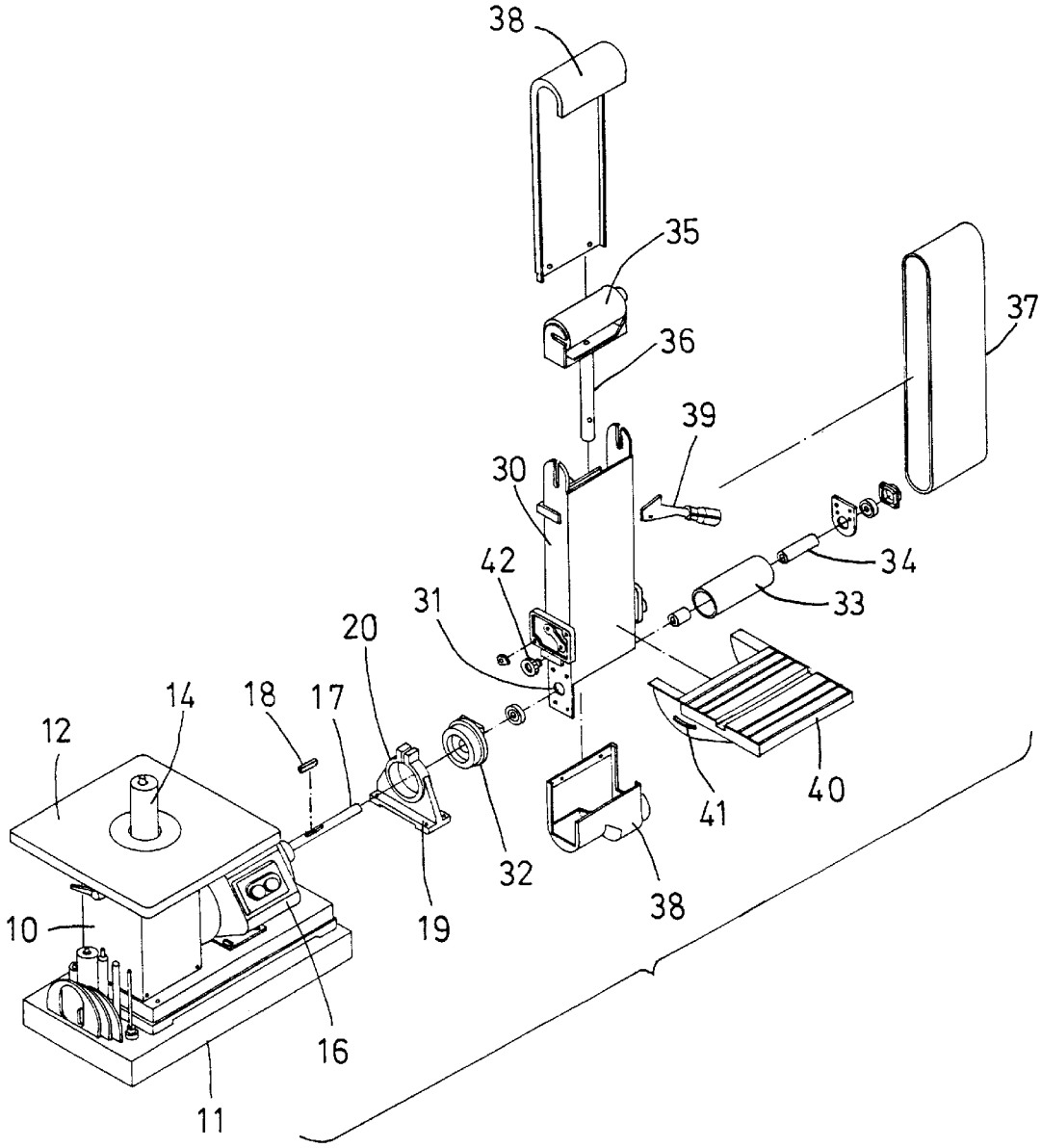

Referring to the drawings, and initially to FIGS. 1–3, a sander assembly in accordance with the present invention comprises a housing 10 disposed on a base 11, a work table 12 disposed on the housing 10, a sander member, such as a sander barrel 14 vertically supported above the work table 12, and a motor 16 disposed on the base 11 and coupled to the vertical sander barrel 14 for rotating and driving the sander barrel 14 to conduct one kind of the sanding operations. An example of a gear coupling for coupling the motor 16 to the sander barrel 14 has been disclosed in U.S. Pat. No. 6,095,906 to Wang which is taken as a reference for the present invention. The motor 16 includes a spindle 17 having a key 18 or the like engaged therein. The spindle 17 has one end extended inward of the housing 10 for coupling to the sander barrel 14, and has the other end extended outward of the motor 16 and extended away from the housing 10.

A seat 19 is secured on the base 11 and includes a clamping ring 20 provided thereon. The spindle 17 is extended through the clamping ring 20. A frame 30 has an extension 31 extended from one end thereof and secured to a hub 32 which is engaged in the clamping ring 20 and adjustably secured to the seat 19 by the clamping ring 20. The hub 32 may further be solidly secured in the clamping ring 20 by a teeth or key engagement for adjustably and stably supporting the frame 30 on the vertical working position (FIGS. 1–3) or on the horizontal working position (FIG. 4) at least. A platform 40 is pivotally secured to the frame 30 and includes one or more curved slots 41 formed therein. One or more fasteners 42 are engaged through the curved slots 41 of the platform 40 and secured to the frame 30 and slidably received in the curved slots 41 of the platform 40 for adjustably securing the platform 40 to the frame 30 at any selected suitable angular position.

A roller 33 is rotatably secured in one end of the frame 30 with a shaft 34 which is secured to the spindle 17 with such as the key 18, such that the roller 33 may be rotated and driven by the motor 16. Another roller 35 is rotatably secured in a bracket 36 which is adjustably secured in the frame 30 and adjustable and movable toward and away from the roller 33. A sander member, such as a sander belt 37 is engaged around the rollers 33, 35. A handle 39 is coupled to the bracket 36 for moving and adjusting the bracket 36 away from the roller 33 and for tightening the sander belt 37 and for solidly engaging and securing the sander belt 37 on the rollers 33, 35. The sander belt 37 may thus be rotated or driven by the motor 16 via the roller 33. One or more covers 38 may be attached to the frame 30 for partially shielding or covering the sander belt 37 and for allowing only the required portions of the sander belt 37 to be exposed for conducting the sanding operations.

Figure 4:
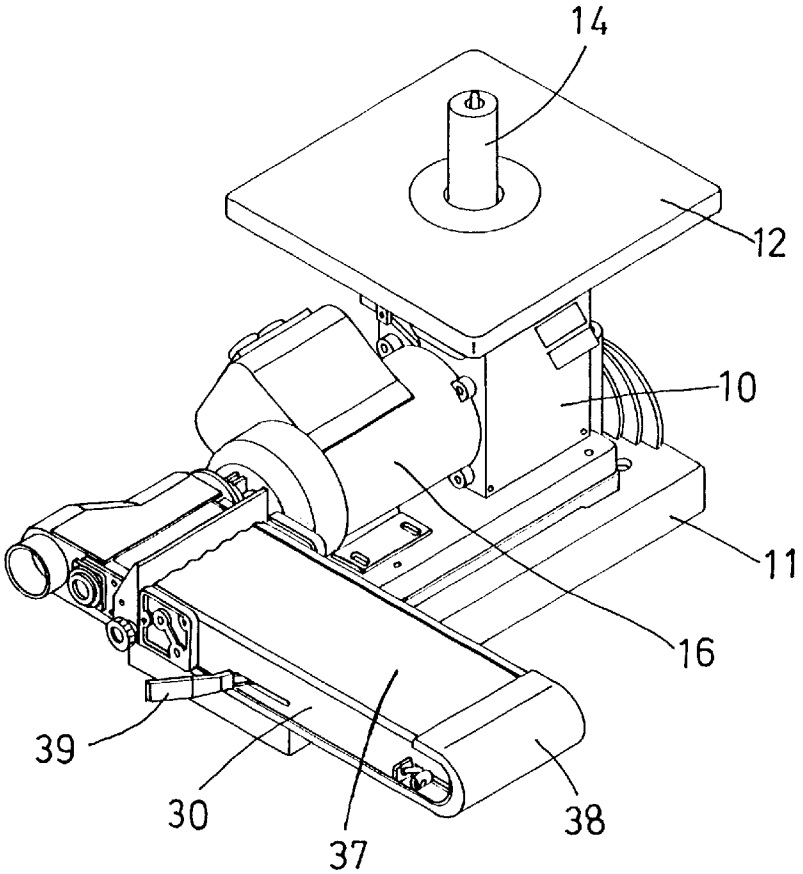
FIG. 4 is a perspective view illustrating the adjustment and the operation of the sander assembly.

In operation, as shown in FIGS. 1 and 4, the frame 30 and thus the sander belt 37 may be adjustably secured to the seat 19 either at the vertical working position (FIG. 1) or at the horizontal working position (FIG. 4), by the adjustably securing of the hub 32 in the clamping ring 20 of the seat 19, in order to selectively conduct two kinds of sanding operations. The platform 40 may be secured to the frame 30 in a horizontal position for supporting the work pieces when the sander belt 37 is supported in the vertical working position (FIG. 2). The platform 40 may be disengaged from the frame 30 when the sander belt 37 is supported in the horizontal working position (FIG. 4). The motor 16 may thus be used to drive two sander members 14, 37, and the sander member

37 may be adjusted between a horizontal working position and a vertical working position. The sander members 14, 37 of the sander assembly in accordance with the present invention may thus be used for conducting at least three kinds of sanding operations.

Accordingly, the sander assembly in accordance with the present invention includes an adjustable sander member that may be adjusted between a horizontal working position and a vertical working position for conducting various kinds of sanding operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sander assembly comprising:

a) a base, b) a housing disposed on said base, c) a work table disposed on said housing, d) a sander barrel supported above said work table, e) a seat disposed on said base and including a clamping ring, f) a motor disposed on said base, and including a spindle having a first end extended into said housing and coupled to said sander barrel for driving said sander barrel, and having a second end extended out of said motor and extended away from said housing and extended through said clamping ring, g) a frame including a shaft rotatably secured therein and secured to said second end of said spindle of said motor for being driven by said motor, h) a first roller secured on said shaft and rotatably secured to said frame with said shaft, for allowing said first roller to be driven by said motor, i) a bracket slidably secured in said frame, j) a second roller rotatably secured in said bracket, k) a sander belt engaged around said first and said second rollers, said bracket being adjustable and movable relative to said first roller for tightening said sander belt, l) a hub secured to said frame and adjustably secured to said seat with said clamping ring, for allowing said frame and said sander belt to be rotated and adjusted relative to said seat and said base, m) a platform secured to said frame for supporting work pieces, n) means for adjustably securing said platform to said frame, and o) at least one cover attached to said frame for partially shielding said sander belt.

* * * * *